US010118307B2

(12) United States Patent
Yamaoka et al.

(10) Patent No.: US 10,118,307 B2
(45) Date of Patent: Nov. 6, 2018

(54) CHAIN SAW

(71) Applicant: CHERVON (HK) LIMITED, Wanchai (HK)

(72) Inventors: Toshinari Yamaoka, Nanjing (CN); Fangjie Nie, Nanjing (CN); Huixing Fu, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 0 days.

(21) Appl. No.: 15/695,202

(22) Filed: Sep. 5, 2017

(65) Prior Publication Data

US 2017/0361487 A1 Dec. 21, 2017

Related U.S. Application Data

(63) Continuation-in-part of application No. 14/694,293, filed on Apr. 23, 2015, now abandoned.

(30) Foreign Application Priority Data

Apr. 29, 2014 (CN) ..... 2014 1 0179369
Apr. 29, 2014 (CN) ..... 2014 2 0216228 U

(51) Int. Cl.

| | |
|---|---|
| ***B27B 17/12*** | (2006.01) |
| ***F04B 53/14*** | (2006.01) |
| ***F04B 53/10*** | (2006.01) |
| ***F04B 53/16*** | (2006.01) |
| ***F04B 7/00*** | (2006.01) |

(52) U.S. Cl.

CPC ..... *B27B 17/12* (2013.01); *F04B 7/0088* (2013.01); *F04B 53/1002* (2013.01); *F04B 53/14* (2013.01); *F04B 53/16* (2013.01); *Y10T 83/707* (2015.04); *Y10T 83/7139* (2015.04)

(58) Field of Classification Search

CPC . B27B 14/12; B27B 14/00; F04B 9/14; F04B 9/042; F04B 15/02; F04B 19/22; F04B 53/10; F04B 53/14; F04B 53/16; F04B 53/1002; F04B 7/04; F04B 5/00; F04B 5/02; Y10T 83/707; Y10T 83/7139

USPC ..... 30/381; 417/470, 490, 570

See application file for complete search history.

(56) References Cited

U.S. PATENT DOCUMENTS

| | | | |
|---|---|---|---|
| 4,683,569 | A | 8/1987 | Wunsch |
| 4,801,253 | A | 1/1989 | Johansson |
| 5,032,067 | A | 7/1991 | Progl |
| 5,184,403 | A | 2/1993 | Schliemann |
| 5,534,145 | A | 7/1996 | Platter |
| 5,829,395 | A | 11/1998 | Brenny |
| 6,019,256 | A | 2/2000 | Seltzer |

OTHER PUBLICATIONS

Canadian Intellectual Property Office, Office Action issued on Canadian patent application No. 2,889,356, dated Jun. 12, 2016, 4 pages.

*Primary Examiner* — Phong Nguyen
(74) *Attorney, Agent, or Firm* — Greenberg Traurig, LLP

(57) ABSTRACT

A chain saw has a fluid pump. The fluid pump has a pump rod, a pump core assembly defining a pumping channel, and a pump body. The pump core assembly has an inner pump core and an outer pump core. The pumping channel is formed at least by a first hole defined in the inner pump core and a second hole defined in the outer pump core and the first hole is in communication with the inlet and the outlet. The pump rod is arranged to do a straight reciprocating motion in the pumping channel along a first axis so as to force fluid to flow from the inlet to the outlet by passing through the first hole.

11 Claims, 4 Drawing Sheets

CHAIN SAW

CROSS REFERENCE TO RELATED APPLICATION

This application is a continuation-in-part of U.S. patent application Ser. No. 14/694,293, filed Apr. 23, 2015, entitled "chain saw and fluid pump," which claims the benefit of CN 201410179369.3, filed on April 29, 2014, and CN 201420216228.X, filed on Apr. 29, 2014, by reference in their entirety, each of which are incorporated herein by reference in their entirety.

BACKGROUND

The present disclosure relates to chain saws.

A chain saw is a tool having a chain on which is mounted blade. It also has a diesel engine or electric motor for driving the chain. When the chain saw is running, an oil pump is provided to force lubricating oil to flow to the chain to allow the chain to move more smoothly.

Generally, the oil pump has a piston chamber and a piston rod. The piston chamber communicates with an oil box and an oil outlet pipe and the piston rod moves in the piston chamber to force oil from the oil box to the oil outlet pipe.

SUMMARY

The present disclosure provides a chain saw, comprising a pump rod; a pump core assembly defining a pumping channel; a pump body defining an inlet, an outlet and a cavity; wherein the cavity is open at one end of the cavity, the outlet is defined at an opposite end of the cavity, and the inlet is defined between the open end of the cavity and the outlet; wherein the pump core assembly comprises an inner pump core disposed in the cavity, and an outer pump core coupling with the pump body at the open end of the cavity; wherein the pumping channel is formed at least by a first hole defined in the inner pump core and a second hole defined in the outer pump core, and the first hole is in communication with the inlet and the outlet; wherein the pump rod is arranged to have a straight reciprocating motion in the pumping channel along a first axis so as to force fluid to flow from the inlet to the outlet by passing through the first hole.

Further, the inner pump core may define a radial hole, and the inlet communicates with the pumping channel by the radial hole.

Further, the chain saw may comprise a check valve assembly for preventing fluid from flowing from the outlet to the inlet; wherein the first hole comprises a communicating section for communicating with the radial hole and a first accommodating section for accommodating the check valve assembly; the radius of the accommodating section being greater than the radius of the communicating section.

Further, the check valve assembly may comprise a valve ball for blocking the first hole and a first bias member for biasing the valve ball to the communicating section.

Further, the inner pump core may define a ring groove at an outside wall of the inner pump core and one end of the radial hole is arranged at the ring groove.

Further, the radius of the communicating section may be approximately equal to the radius of the pump rod.

Further, the chain saw may comprise a sealing ring for preventing fluid from flowing along the pump rod; the sealing ring is disposed between the inner pump core and the outer pump core, and the pump rod is arranged to pass through the sealing ring.

Further, the inner pump core may comprise a protruding portion protruding along the first axis, and the second hole may comprise a second accommodating section for accommodating the protruding portion and the sealing ring.

Further, the sealing ring may be arranged between the end face of the protruding portion and the end face of the second accommodating.

Further, the chain saw may comprise a cap coupling with the pump rod at the outer end of the pump rod and a second bias member for biasing the cap to moving away from the pump body.

DETAILED DESCRIPTION

Figure 1:
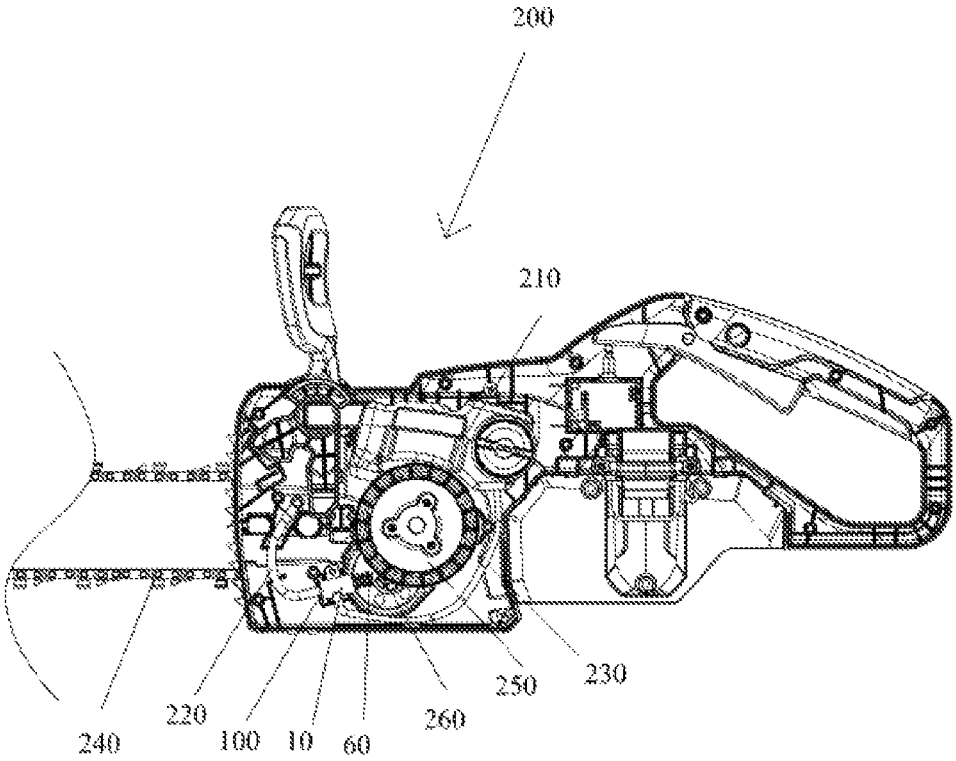
FIG. 1 is a structure schematic view of an exemplary chain saw of the present disclosure.
Figure 2:
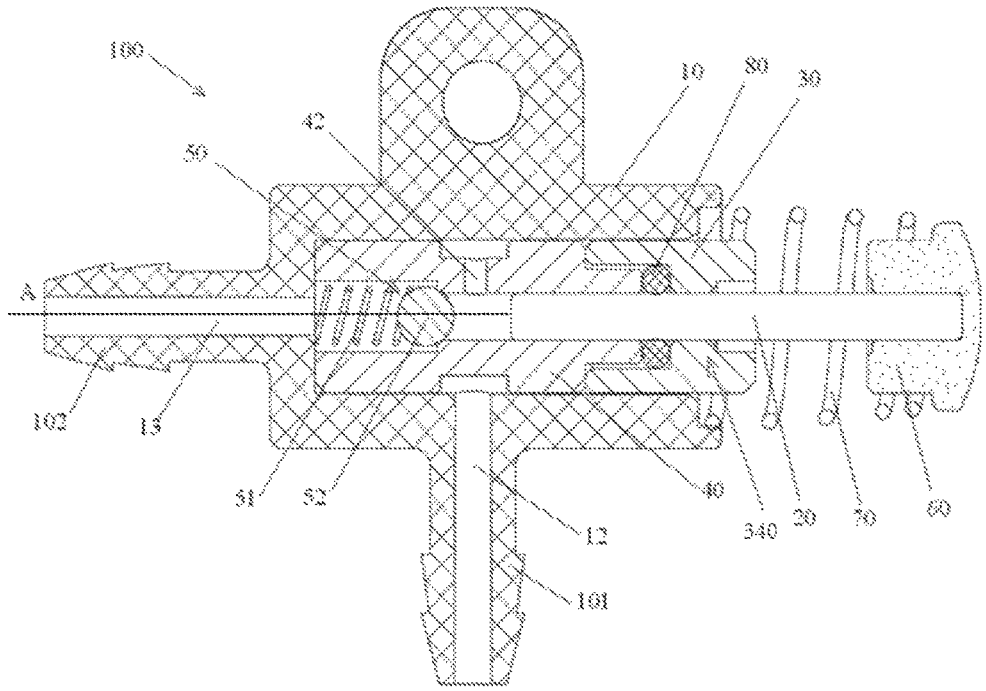
FIG. 2 is a sectional view of the fluid pump of the chain saw as show in FIG. 1.
Figure 3:
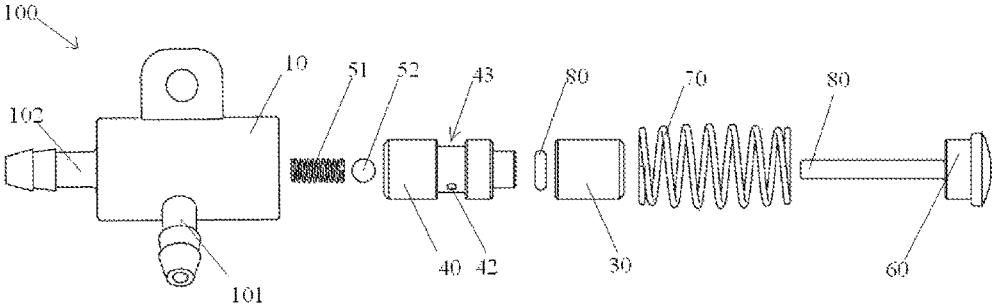
FIG. 3 is an exploded view of the fluid pump as shown in FIG. 2.
Figure 4:
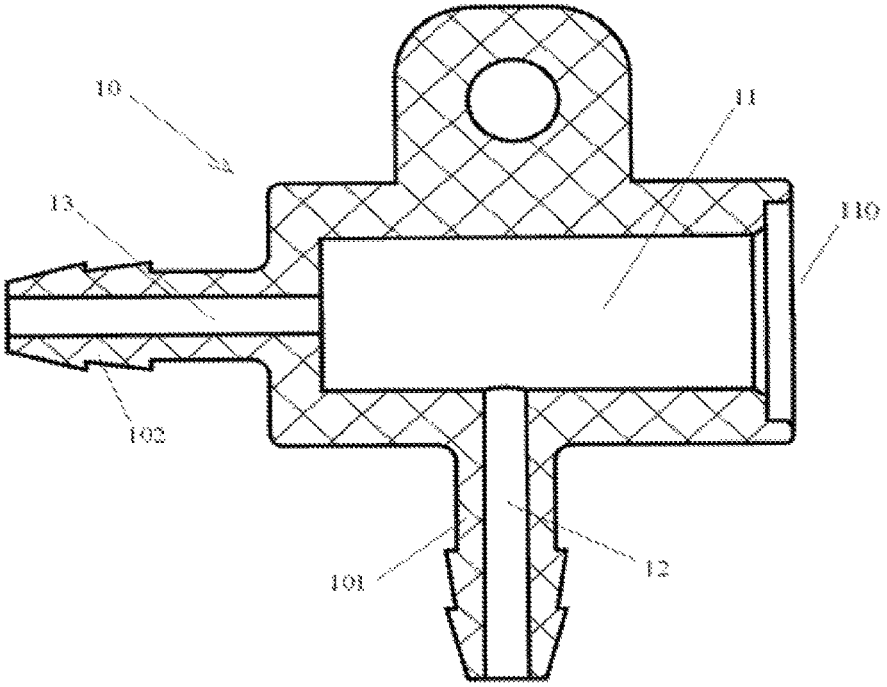
FIG. 4 is a sectional view of the pump body of the fluid pump as shown in FIG. 2.
Figure 5:
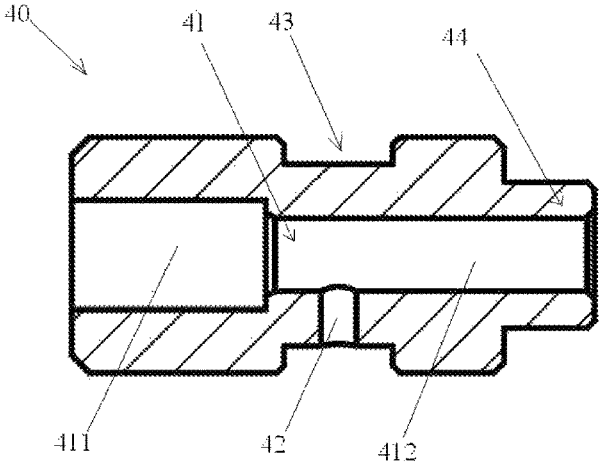
FIG. 5 is a sectional view of the inner pump core of the fluid pump as shown in FIG. 2.
Figure 6:
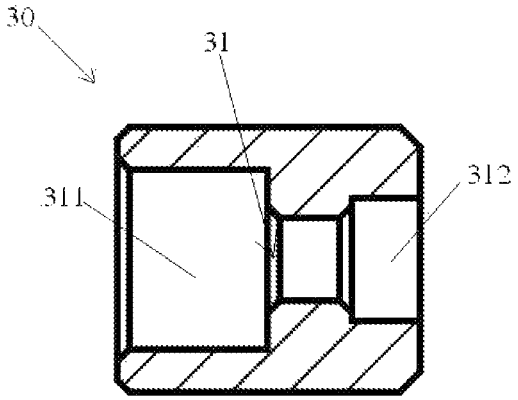
FIG. 6 is a sectional view of the outer pump core of the fluid pump as shown in FIG. 2.

As shown in FIG. 1, a chain saw 200 may comprise a motor 250, a chain 240, and a transmission mechanism for driving the chain 240. The chain saw 200 may further comprise an oil system for lubricating the chain 240. Specifically the oil system may comprise the fluid pump 100, an impact device for impacting the cap 60 of the fluid pump 100, an oil box 210 and an output tube 220.

Referring to FIG. 2-6, a fluid pump 100 comprises a pump body 10, a pump rod 20, and pump core assembly 340.

The pump body 10 forms a cavity 11, an inlet 12, and an outlet 13. The cavity 11 is a space for accommodating the pump core assembly 340 in the internal of the pump body 10. The cavity 11 has an opening 110 at one end. The cavity 11 has an open end for assembling the pump core assembly 340. The outlet 13 is arranged at a shut end of the cavity 11. The open end and the shut end are opposite ends of the cavity 11, and the inlet 12 is arranged between these two opposite ends of the cavity 11.

Preferably the pump body 10 may comprise an inlet portion 101 for coupling an input tube 230 communicating with an oil box 210, and the pump body 10 may further comprise an outlet portion 102 for coupling an output tube 220 arranged to output oil to the chain 240 of the chain saw 200. The inlet 12 is defined at the inlet portion 101, and the outlet 13 is defined at the outlet portion 102.

Preferably the direction which the inlet 12 extends is perpendicular to the direction which the outlet 13 extends.

The pump core assembly 340 may comprise an outer pump core 30 and an inner pump core 40. The inner pump core 40 forms a first hole 41 and the outer pump core 30 forms a second hole 31. The pump core assembly 340 defines a pumping channel at least consisting of the first hole 41 and the second hole 31.

The first hole 41 is arranged to communicate with the outlet 13 and the second hole 42. For allowing the inlet 12 to communicate with the outlet 13 by the first hole 41, the inner pump core 40 further forms a radial hole 42. Preferably the first hole 41 is centre-symmetric about the first axis A, and the radial hole 42 may extend in a radial direction relative to the first hole 41.

The pump rod 20 is arranged to do a straight reciprocating motion in the pumping channel along a first axis A.

When the pump rod 20 moving towards the outlet 13, the pump rod 20 forces fluid in the first hole 41 flowing to outlet 13. When the pump rod 20 moves away from the outlet 13, the pump rod 20 functions to pump fluid from the inlet 12 to the first hole 41.

Preferably, for preventing fluid flowing from the outlet 13 to the inlet 12, the fluid pump 100 may further comprise a check valve assembly 50.

The check valve assembly 50 may comprise a first bias member 51 and a valve ball 52. The first hole 41 may define a first accommodating section 411 and a communicating section 412. The radius of the first accommodating section 411 is greater than the radius of the communicating section 412. The check valve assembly 50 is arranged at a first accommodating section 411. The radial hole 42 has a open end at the communicating section 412 so as to communicates with the first hole 41.

The first bias member 51 is arranged to bias the valve ball 52 to the communicating section 412. Because the first hole 41 forms a step structure between the first accommodating section 411 and the communicating section 412, the step structure will prevent valve ball 52 from moving further, and the valve ball 52 is capable of blocking the first hole 41 at this position.

When the pump rod 20 moves to contact the valve ball 52, the pump rod 20 will force the valve ball 52 away from the position for blocking the first hole 41 so as to allow fluid to flow from the inlet 12 to the outlet 13 by passing through the first hole 41.

When the pump rod 20 moves away from the first accommodating section 411, the first bias member 51 will bias the valve ball 52 to the position for blocking the first hole 41 so as to prevent fluid flowing from the outlet 13 to the inlet 12 by passing through the first hole 41. Thus the check valve assembly 5 functions to prevent oil from flowing from the outlet 13 to the inlet 12.

Preferably, the radius of the communicating section 412 is approximately equal to the radius of the pump rod 20.

Preferably, the inner pump core 40 defines a ring groove 43 at an outside wall of the inner pump core 40, and one end of the radial hole 42 is arranged at the ring groove 43. Specifically the radial hole 42 has an open end in the ring groove 43. The ring groove 43 is arranged to receive fluid so as to keep fluid flow into the radial hole 42 steady.

Preferably, the fluid pump 100 may further comprise a sealing ring 80 for preventing fluid from flowing along the pump rod 20. The sealing ring 80 is disposed between the inner pump core 40 and the outer pump core 30, and the pump rod 20 is arranged to pass through the sealing ring 80.

Specifically, the inner pump core 40 comprises a protruding portion 44 protruding along the first axis A, and the second hole 31 may comprise a second accommodating section 311 for accommodating the protruding portion 44 and the sealing ring 80.

The sealing ring 80 disposed between the inner pump core 40 and the outer pump core 30 increases the seal-ability and assembling ability of the fluid pump 100.

Preferably, the inner pump core 40 and the outer pump core 30 are coupled with the pump body 10 in an interference fit manner.

Preferably, the fluid pump 100 may comprise a cap 60 coupling with the pump rod 20 at the outer end of the pump rod 20, and a second bias member 70 for biasing the cap 60 to move away from the pump body 10. Specifically the second bias member 70 is a spiral spring.

When the motor 250 runs, the transmission mechanism drives the chain 240 and the impact device. The impact device is arranged for straight reciprocating motion along a first axis A. When the impact device moves close to the pump body 10, the impact device pushes the pump rod 20 moving it closer to the outlet 13. When the impact device is moving away from the pump body 10, the second bias member 70 is biasing the pump rod 20 moving it away from the outlet 13.

The input tube 230 provides fluid communication between the fluid pump 100 and the oil box 210. The output tube 220 is arranged to output oil from the fluid pump 100 to the chain 240. The fluid pump 100 is continuously driven by the motor 250. A eccentric wheel 260 is driven by the motor 250. The eccentric wheel 260 impacts on the cap 60 circularly. When the cap 60 is moving close to the pump body 10, the oil flows from the fluid pump 100 to the chain 240. When the cap 60 is moving away from the pump body 10, the oil flows from the oil box 210 to the fluid pump 100.

The above illustrates and describes basic principles, main features and advantages of the present disclosure. Those skilled in the art should appreciate that the above embodiments are not intended to limit the invention claimed in any form. Rather, technical solutions obtained in a way of equivalent substitution or equivalent variations are intended to fall within the scope of the claims which follow.

We claim:

1. A chain saw, comprising:

a motor, a chain having a plurality of blades driven by the motor, and a fluid pump for providing a lubricating fluid to the chain;

wherein the fluid pump comprises:

a pump rod;

a pump core assembly defining a pumping channel; and a pump body defining an inlet, an outlet, and a cavity having an opening at one end;

wherein the outlet is defined at an end of the cavity opposite to the opening and the inlet is defined between the opening and the outlet;

wherein the pump core assembly comprises:

an inner pump core disposed in the cavity, and an outer pump core coupled with the pump body at the opening;

wherein the pumping channel is formed at least by a first hole defined in the inner pump core and a second hole defined in the outer pump core, and the first hole is in communication with the inlet and the outlet; and wherein the pump rod is arranged to have a straight reciprocating motion in the pumping channel along a first axis so as to force the lubricating fluid to flow from the inlet to the outlet by passing through the first hole.

2. The chain saw according to claim 1, wherein the inner pump core further defines a radial hole and the inlet communicates with the pumping channel by the radial hole.

3. The chain saw according to claim 2, further comprising a check valve assembly for preventing fluid from flowing from the outlet to the inlet, wherein the first hole comprises a communicating section for communicating with the radial hole and a first accommodating section for accommodating the check valve assembly and wherein the radius of the accommodating section is greater than the radius of the communicating section.

4. The chain saw according to claim 3, wherein the check valve assembly comprises a valve ball for blocking the first hole and a first bias member for biasing the valve ball towards the communicating section.

5. The chain saw according to claim 2, wherein the inner pump core defines a ring groove at an outside wall of the inner pump core and one end of the radial hole is arranged at the ring groove.

6. The chain saw according to claim 3, wherein the radius of the communicating section is approximately equal to the radius of the pump rod.

7. The chain saw according to claim 1, further comprising a sealing ring for preventing fluid from flowing along the pump rod wherein the sealing ring is disposed between the inner pump core and the outer pump core and the pump rod is arranged to pass through the sealing ring.

8. The chain saw according to claim 7, wherein the inner pump core comprises a protruding portion protruding along the first axis and the second hole comprises a second accommodating section for accommodating the protruding portion and the sealing ring.

9. The chain saw according to claim 8, wherein the sealing ring is arranged between the end face of the protruding portion and the end face of the second accommodating section.

10. The chain saw according to claim 1, further comprising a cap coupled with the pump rod at the outer end of the pump rod and a second bias member for biasing the cap to move away from the pump body.

11. The chain saw according to claim 1, wherein the motor drives the pump rod to move along the first axis.

* * * * *